US007806559B2

(12) United States Patent
Reed

(10) Patent No.: US 7,806,559 B2
(45) Date of Patent: Oct. 5, 2010

(54) FORMABLE DECORATIVE LIGHT SET

(76) Inventor: Benjamin David Reed, 170 Davis Farm Rd., Pembroke, KY (US) 42266

( * ) Notice: Subject to any disclaimer, the term of this patent is extended or adjusted under 35 U.S.C. 154(b) by 0 days.

(21) Appl. No.: 11/585,005

(22) Filed: Oct. 23, 2006

(65) Prior Publication Data

US 2007/0091606 A1 Apr. 26, 2007

Related U.S. Application Data

(60) Provisional application No. 60/729,654, filed on Oct. 24, 2005.

(51) Int. Cl.
*F21S 4/00* (2006.01)

(52) U.S. Cl. ..... 362/249.02; 362/568; 362/806

(58) Field of Classification Search ..... 362/252, 362/568, 122, 123, 249, 458, 806, 238, 382
See application file for complete search history.

(56) References Cited

U.S. PATENT DOCUMENTS 3,404,268 A * 10/1968 Fowler ..... 362/382
4,335,422 A * 6/1982 Van Ess ..... 362/388
4,638,117 A * 1/1987 Ney ..... 174/117 F
4,769,749 A * 9/1988 Felski ..... 362/250
5,018,055 A * 5/1991 Wu ..... 362/238
5,288,047 A * 2/1994 Pan ..... 248/229.26
5,410,460 A * 4/1995 Liou ..... 362/250
5,526,246 A * 6/1996 Liou ..... 362/252
5,584,567 A * 12/1996 Rumpel ..... 362/249
5,727,872 A * 3/1998 Liou ..... 362/252
6,056,418 A * 5/2000 Hsu ..... 362/249
6,260,987 B1 * 7/2001 Wu ..... 362/252
6,352,355 B1 * 3/2002 Law ..... 362/253
6,595,658 B2 * 7/2003 Tsai ..... 362/227
6,598,995 B2 * 7/2003 Huang ..... 362/249
7,014,352 B2 * 3/2006 Wu ..... 362/653
7,018,066 B2 * 3/2006 Kirven ..... 362/249
2003/0081416 A1 * 5/2003 Hsu ..... 362/249

* cited by examiner

*Primary Examiner*—Gunyoung T Lee
(74) *Attorney, Agent, or Firm*—Stephen J. Stark; Miller & Martin PLLC

(57) ABSTRACT

Disclosed is a decorative light string, being formable to provide varying shapes, to hold position when wrapped around or placed upon structures to be decorated, and to facilitate storage without tangling of one or more light strings.

2 Claims, 3 Drawing Sheets

FORMABLE DECORATIVE LIGHT SET

This application claims the benefit of priority of earlier filed U.S. Patent Application No. 60/729,654, filed on Oct. 24, 2005.

FIELD OF THE INVENTION

The present invention relates generally to lighting fixtures. More specifically, the invention relates to strings of lights such as those used as Christmas decorations.

BACKGROUND OF THE INVENTION

A conventional string of lights comprising one, or a plurality of, current-carrying wires of different desired lengths, having multiple sockets and lights attached at certain intervals, can be used to provide cosmetic effects, such as being wrapped around a tree indoors or outdoors for a decorative effect. A string of lights can also be placed on a banister, an umbrella, a gutter, or a window frame. However, a conventional light string, when used in these and other instances, requires an external attachment device. Some examples of conventional external attachment devices are staples, twist-ties, pipe cleaners, glues, tapes, nails, and numerous other devices. These methods of attachment can cause permanent damage to the lighting string and can be very time consuming to attach, as well as unsightly. Also, storage of decorative light strings has long been a problem. When light strings are put away for storage, they inevitably tangle and knot. When removing the lights from storage for further use, the tangling is sometimes so severe that the strand must be thrown away and replaced by a new strand. What is needed is a component or method to make the string of lights hold numerous different shapes without the need for external attachment devices and to make the light string less likely to tangle when being put away and removed from storage.

SUMMARY OF THE INVENTION

The present invention provides a single string or multiple strings of lights comprised of one or a plurality of current-carrying wires having multiple sockets and bulbs attached at intervals thereto, and a semi-rigid flexible wire or wires attached to the current-carrying wire or wires so that the semi-rigid flexible wire runs parallel to the current-carrying wire. By semi-rigid flexible wire I mean a wire that easily bent by hand strength but also strong enough to hold its shape once bent.

In one embodiment, the semi-rigid flexible wire is coated by a protective but flexible coating. In some embodiments, the coating surrounds both the semi-rigid flexible wire and the current-carrying wire collectively. In some embodiments, the semi-rigid flexible wire may be separately coated, as may the current-carrying wire or wires, and the coated wires may be attached by clamps placed at intervals thereupon.

DETAILED DESCRIPTION OF THE INVENTION

The inventor has developed a light string, comprising at least one current-carrying wire having one or more lamps, or sockets for receiving bulbs, functionally attached thereto, and at least one flexible wire running parallel to the current-carrying wire and attached to the current-carrying wire so that bending or shaping the flexible wire will result in a similar bending or shaping of the current-carrying wire. The various embodiments of the invention can provide a string of lights that is formable (i.e., may be formed into numerous different shapes without the use of external attachment devices or tools), is less likely to tangle, and is less likely to sag or droop when stretched over a certain distance. As used herein, a "flexible" wire is a wire that may be bent or formed into a desired shape using force that may be easily applied by human hands. Where one flexible wire is indicated, it is to be understood that more than one flexible wire may also be used. A flexible wire should be somewhat rigid so that it will retain its position once formed into a shape (e.g., a curve, the shape of a letter, a square, etc.), but should retain the desired flexibility to be bendable and formable, so that the light string may be formed into various shapes, wrapped around Christmas trees, poles, rails, or other structures, and later reshaped for attachment to other structures, or wound so that they may be put away for storage after use.

Figure 1:
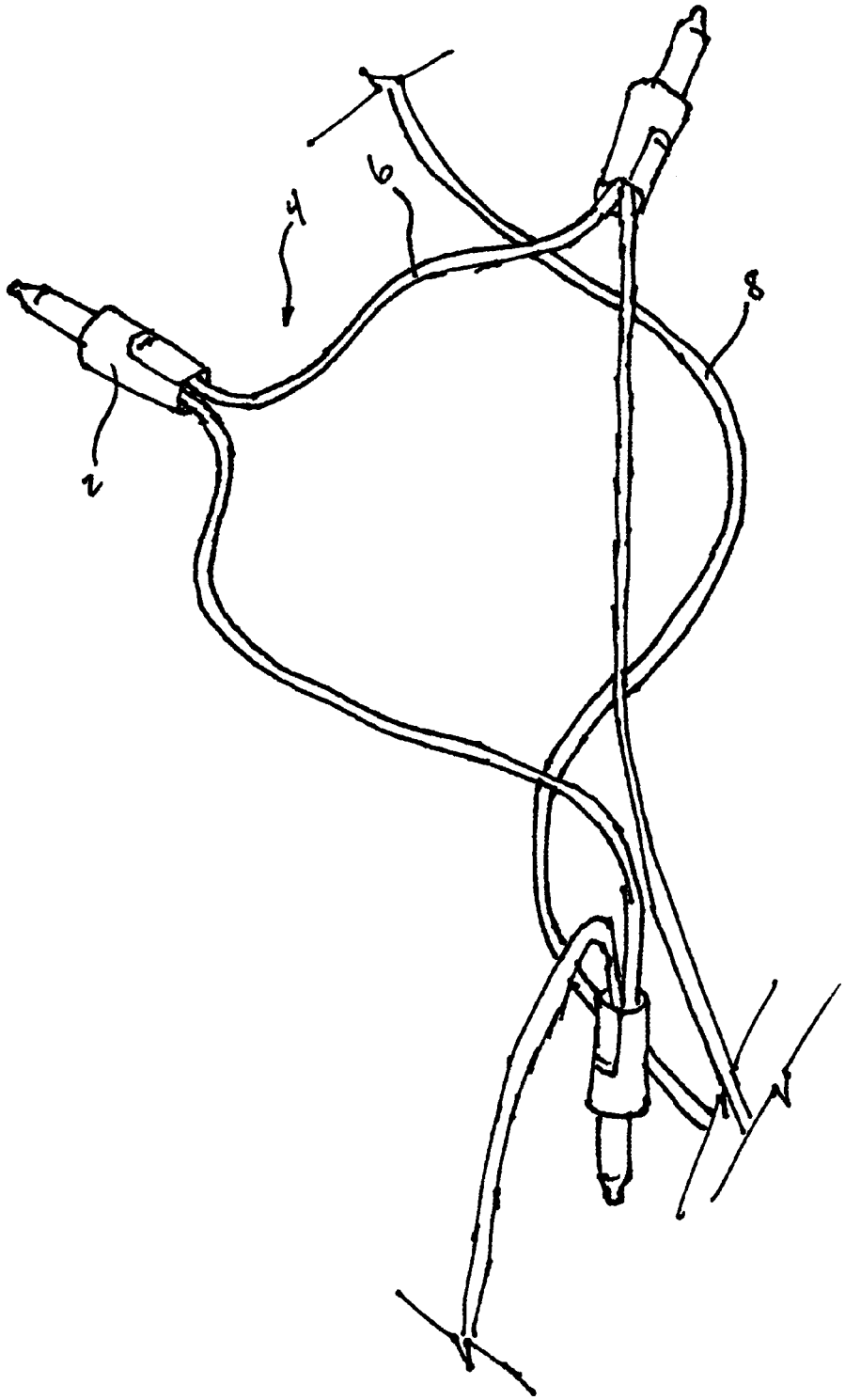
FIG. 1 is an illustration of the various components of a string of lights as described by the present invention with the string of lights and the semi-rigid flexible wire.
Figure 2:
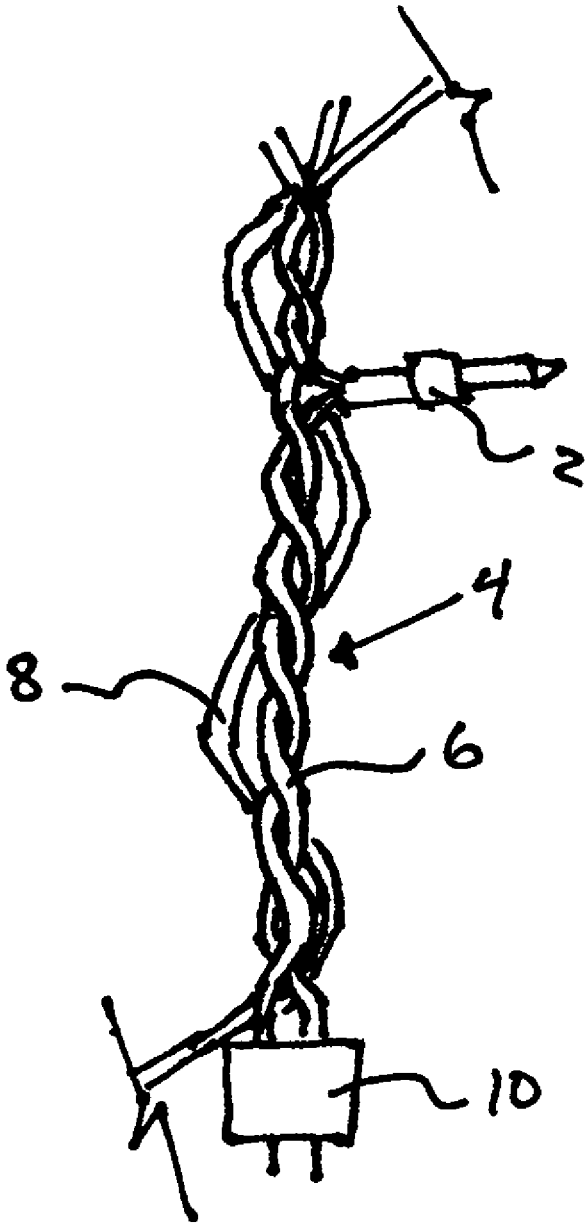
FIG. 2 is a perspective view of one embodiment of the present invention wherein a semi-rigid flexible wire is loosely intertwined with a current-carrying wire in a light strand.

With reference to FIG. 1 of the drawings, the semi-rigid flexible light string of the present invention comprises generally a string of lights 4, made with current carrying electric wires 6, a plurality of sockets 2 ending with a plug 10 and wrapped with an intertwining semi-rigid flexible wire 8. The string of lights 4 may be made formable by incorporating the semi-rigid flexible wire or wires 8 into the existing coated electrical current-carrying wires 6 that make up the light sting 4. Alternately, the string of lights 4 could be made formable by clamping a semi-rigid flexible wire or wires 8 at certain intervals to the light string 4 or sockets 2. In another embodiment, the string of lights 4 could be made formable by attaching the flexible wire or wires 8 to the individual light sockets 2. The sting of lights 4 could be made formable, as well, by using flexible but formable wire as current-carrying wires attached to the lamps or sockets.

Figure 3:
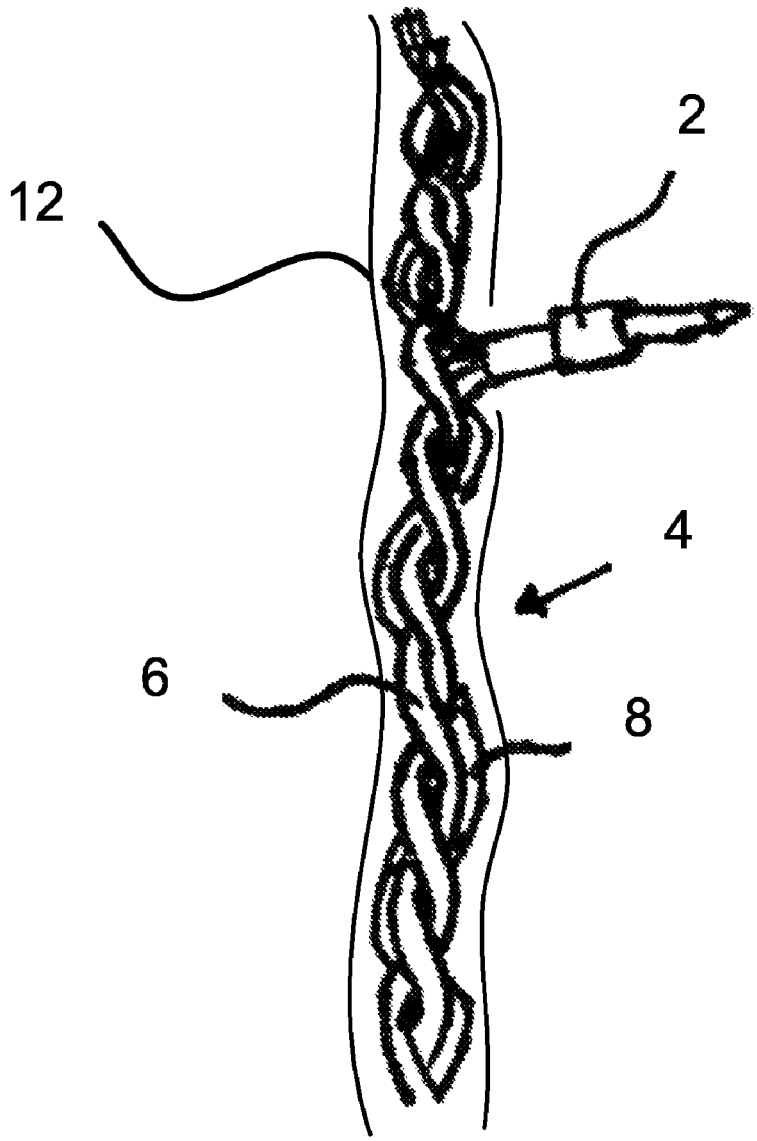
FIG. 3 is a perspective view of a light string as described by the present invention, where the semi-rigid flexible wire is tightly intertwined with the light strand.

One embodiment of the invention, illustrated in FIG. 3, is a string of lights comprising current-carrying electric wires 6, a plurality of sockets 2 functionally attached thereto and terminating at a plug 10, the current-carrying wires wrapped with an intertwining flexible wire 8 that has a plastic coating of the same coating material and color as the current-carrying electric wires 6.

Attachment of the flexible wire to the current-carrying wire or wires is not limited to direct attachment so that there is direct contact between the wires, which is less desirable than functional attachment of the flexible wire to the current-carrying wire or wires so that there may be one or more layers of coating materials surrounding the flexible wire and/or current-carrying wire individually or collectively and physically positioned between a current-carrying wire and a flexible wire. Attachment may be accomplished by enclosing a flexible wire within a coating or sheath 12 surrounding both the flexible wire and one or more current-carrying wires. Attachment may also be accomplished by enclosing a coated flexible wire and a separately-coated current-carrying wire or wires within a second coating or sheath. Individually-coated wires, for example, may be bundled into one sheath through which sockets are functionally attached to at least one current-carrying wire. In other embodiments, attachment may also be achieved through the use of clamps, ties, or other attachment devices positioned at fixed or varied intervals along the length of the parallel current-carrying wire or wires and flexible wire or wires.

A flexible wire of the present invention may be formed of various materials, including, for example a copper wire that is thick enough to bend and hold its shape, a metal wire that is thick enough to bend easily and hold its shape, an aluminum alloy wire, or a galvanized steel wire that is thick enough to bend easily and hold its shape.

In making my real sample of the lights I used a set of 100 clear string lights from Target. Following the natural twist of the original light string I wrapped a 12 gauge galvanized steel fencing repair wire, brand name OOK around in circles and clamped the wire to each end of the string lights by tying a knot and crimping the wire. I then painted the wire the same green color as the original string.

Suitable coating materials for current-carrying wires of the present invention may comprise, for example, silicon rubber, plastic, and nylon. Suitable coating materials for a flexible wires may comprise, for example, silicon rubber, plastic, nylon, paint, rust-oleum, rayon, and polyester.

What is claimed is:

1. A formable light string, comprising:

at least one current-carrying wire having a predetermined length with a plurality of sockets functionally attached thereto;

a single flexible wire running parallel to and attached to the at least one current-carrying wire, the flexible wire being bendable and formable to a variety of shapes by force applied by human hands, without a use of implements, and holding a shape once formed, without a use of clips, the flexible wire extending the length of the current-carrying wire; and at least one sheath surrounding and encapsulating both the single flexible wire and the at least one current-carrying wire, respectively, the at least one current-carrying wire having sockets that extend out through the at least one sheath.

2. The formable light string of claim 1, wherein the at least one current-carrying wire extends from a plug.

* * * * *